United States Patent [19]

Matsuoka

[11] Patent Number: 4,795,385

[45] Date of Patent: Jan. 3, 1989

[54] DIVING FIN

[75] Inventor: Mitsushiro Matsuoka, Tokyo, Japan

[73] Assignee: Tabata Co Ltd, Tokyo, Japan

[21] Appl. No.: 143,754

[22] Filed: Jan. 14, 1988

[30] Foreign Application Priority Data

Jan. 14, 1987 [JP] Japan ..... 62-7716

[51] Int. Cl.[4] ..... A63B 31/08

[52] U.S. Cl. ..... 441/64; D21/239

[58] Field of Search ..... 441/61-64; 280/11.3, 611; D21/239

[56] References Cited

U.S. PATENT DOCUMENTS

| | | | |
|---|---|---|---|
| D. 203,364 | 12/1965 | Brunner | D21/239 |
| D. 233,247 | 10/1974 | Tabata | D21/239 |
| 2,737,668 | 3/1956 | Cressi et al. | 441/64 |
| 2,779,077 | 1/1957 | Kline | 441/64 |
| 3,112,503 | 12/1963 | Girden | 441/64 |
| 3,183,529 | 5/1965 | Beuchat | 441/64 |
| 3,940,815 | 3/1976 | Hill | 441/64 |
| 4,251,894 | 2/1981 | Hollingsworth | 441/64 |

*Primary Examiner*—Joseph F. Peters, Jr.
*Assistant Examiner*—Jesûs D. Sotelo
*Attorney, Agent, or Firm*—Fred Philpitt

[57] ABSTRACT

A diving fin includes a heel strap coupled to opposite sides of a foot pocket wherein coupling of at least one end of the strap to at least one of the opposite sides of the foot pocket as well as adjustment of the fastening effect of the strap on the divers heel can be achieved by a buckle. The buckle comprises a first coupling member of sheath-like configuration and a second coupling member having a plug portion adapted to be releasably engaged into the first coupling member and a retaining frame movably supports therearound the strap.

5 Claims, 3 Drawing Sheets

DIVING FIN

BACKGROUND OF THE INVENTION

1. Field of Industrial Application

The present invention relates to diving fins (or flippers) for divers and more particularly to means by which a heel strap can be releasably coupled to the associated fin and a fastening effect thereof can be adjusted when a diver desires to fasten the heel after the front of the foot has been inserted into a foot pocket of this fin.

2. Prior Art and Problems to be Solved by the Invention

Coupling and adjustable fastening of the heel strap in such fin have usually been achieved by means such as a connector ring or a buckle. However, said means of prior art have generally required relatively complicated handling and said adjustment of the fastening effect has been possible only before diving. With a consequence, such means of prior art have been extremely inconvenient in that not only it is impossible to meet a demand in case of emergency but also it is impossible to refasten the heel strap during diving when the strap has been loosened due to factors such as a violent movement of the diver in water or a Water pressure.

A principal object of this invention is to provide improved diving fin which can solve the above-mentioned problems by coupling the heel strap to the fin through use of a novel buckle.

SUMMARY OF THE INVENTION

The diving fin according to the present invention includes a heel strap coupled to opposite sides of a foot pocket wherein coupling of at least one end of said strap to at least one of said opposite sides of the foot pocket as well as adjustment of fastening effect of said strap on the diver's heel can be achieved by a buckle. Said strap carries on one side a plurality of first latch teeth arranged to be spaced from one another longitudinally of said strap. Said buckle comprises a first coupling member of sheath-like configuration and a second coupling member having a plug portion adapted to be releasably engaged into said first coupling member and a retaining frame movably supporting therearound said strap. Said retaining frame includes a movable latching piece swingably supported therein by suitable support means so that said movable latching piece is normally biased by a spring and thereby the inner surface at one end is urged against any one of said first latch teeth. Said movable latching piece includes a second latch tooth on said inner surface at the one end adapted to be engaged with any one of said first latch teeth in order to prevent said strap from moving in the direction in which said strap is loosened and adapted to swing off from said one of said first latch teeth around said support means against action of said spring allowing said strap to move in said fastening direction.

In accordance with the present invention constructed as has been set forth above, the buckle at least serving to couple one end of the heel strap to one of the opposite sides of the foot pocket comprises the first coupling member and the second coupling member of which the plug portion is releasably engaged into said first coupling member, and the second latch tooth of the movable latching piece mounted on the retaining frame of said second coupling member can be selectively engaged with one of the first latch teeth of said strap put around the pin of said retaining frame. This feature of the invention extremely facilitates not only coupling but also adjustable fastening of said strap.

Moreover, said adjustable fastening can be achieved merely by pulling said strap in the direction in which said strap is tightened even during diving and the fastened condition thus established can be reliably maintained by the selective engagement of said second latch tooth with one of said first latch teeth. This feature of the invention reliably prevents the strap from being inadvertently loosened during diving.

The diving fin constructed in accordance with the present invention thus solves the problems as have been set forth and provides significant advantages in practical use.

BRIEF DESCRIPTION OF THE DRAWINGS

A specific embodiment of the present invention is illustrated by the accompanying drawings in which.

PREFERRED EMBODIMENT OF THE INVENTION

Figure 1:
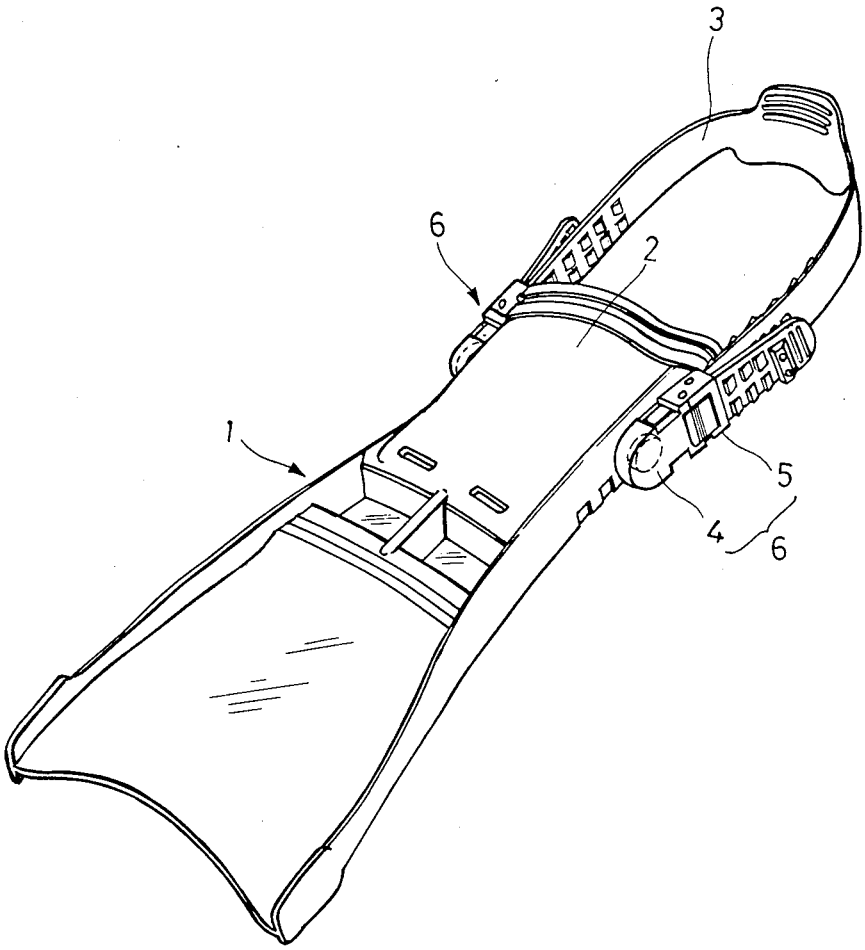
FIG. 1 is a general perspective view of the diving fin.

Referring to FIG. 1, a diving fin (or flipper) 1 is made of relatively soft synthetic resin or rubber and provided with a heel strap 3 to fasten the heel after a diver has inserted the front of the foot into a foot pocket 2. The strap 3 is coupled to said fin 1 by a buckle 6 consisting of a pair of first coupling members 4 respectively mounted on opposite sides of the foot pocket 2 and a pair of second coupling members 5 carried by opposite ends of said strap.

Figure 2:
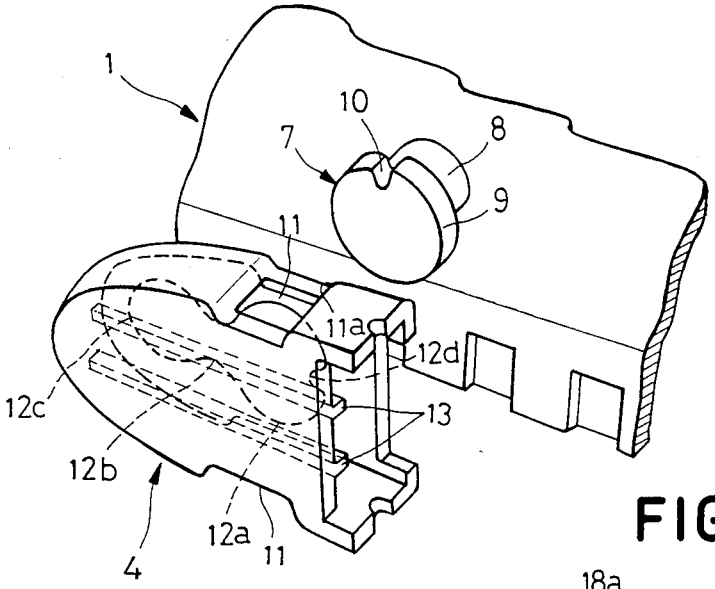
FIGS. 2 and 3 are perspective views of a buckle prior to assembly.

Referring to FIG. 2, the fin 1 is formed on the opposite sides with a pair of interlocking projections 7, respectively. Each of the interlocking projections 7 comprises a cylindrical neck portion 8 and a disc-like flange 9 formed on the outer end of said neck portion 8. Said flange has its outer periphery partially cut away to form a notch 10. It should be understood here that the interlocking projection 7 is integral with the fin 1 made of synthetic resin or rubber and thus somewhat elastic.

Figure 4:
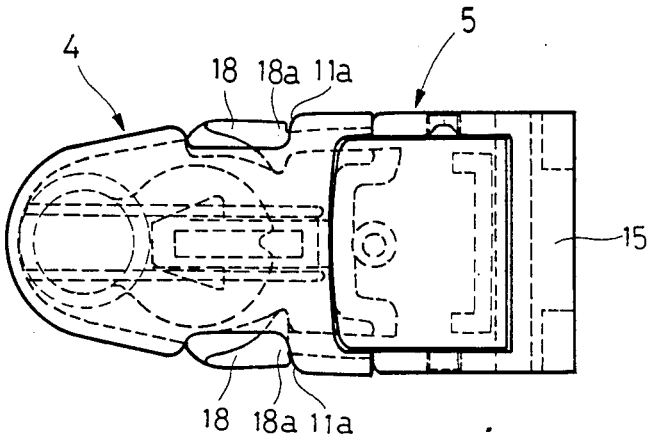
FIG. 4 is a plan view of the buckle as has been assembled.
Figure 5:
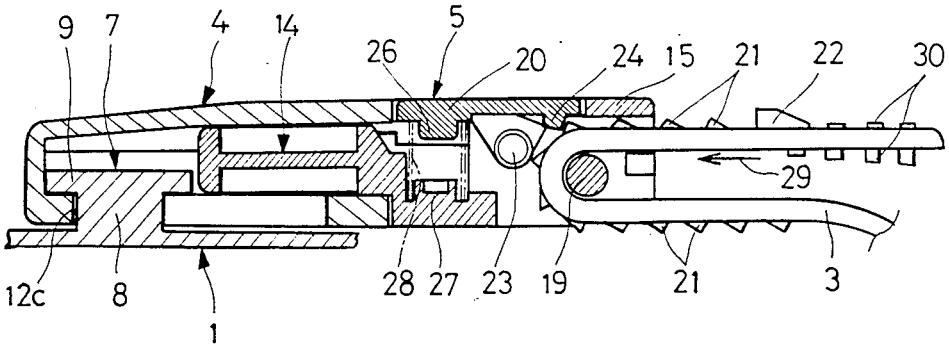
FIG. 5 is a longitudinal sectional view of the buckle after assembled.

Concurrently in reference with FIGS. 2, 4 and 5, each of the first coupling members 4 is made of synthetic resin as a sheath-like component opening at its rear end. The first coupling member 4 includes a pair of windows 11 respectively formed in opposite sides thereof, a guide aperture 12*a* of a substantially same diameter as that of the flange 9 formed in the inner side wall confronting the fin 1 and an interlocking aperture 12*c* substantially corresponding in a diameter to the neck portion 8 and communicating with said guide aperture 12*a* through a constricted passage 12*b* which is slightly narrower than the diameter of said neck portion 8. The guide aperture 12*a* is provided on its inner periphery with a projection 12*d* matching with the notch 10. To couple the first coupling member 4 to the fin 1, the first coupling member 4 is counterclockwise rotated by 90° from its lying down position as shown by FIG. 2, then the flange 9 is inserted, with the projection 12*d* maintained in alignment with the notch 10, into the first coupling member 4 through the guide aperture 12*a*, thereafter the first coupling member 4 is rotated back to its lying down position, then said first coupling member 4 is pulled rearwards with respect to the fin 1 so that the neck portion 8 may pass against its own elasticity through the constricted passage 12*b* and thereby said neck portion 8 is tightly received in the interlocking aperture 12*c*. Once the first coupling member 4 has been coupled to the fin 1 in this manner, the flange 9 is effectively confined inside the wall defining said interlocking aperture 12*c*. Accordingly, the first coupling members 4 have already been set so as to be reliably prevented from moving forwards when the diver puts on the fins 1 and thus there is no possibility that said first coupling members 4 could fall off from the respective interlocking projections 7 during use of the fins 1. Each of the first coupling members 4 is provided on the inner surface of its outer wall with guide ridges 13 for guide levers of the associated second coupling member 5 as will be described later.

Figure 3:
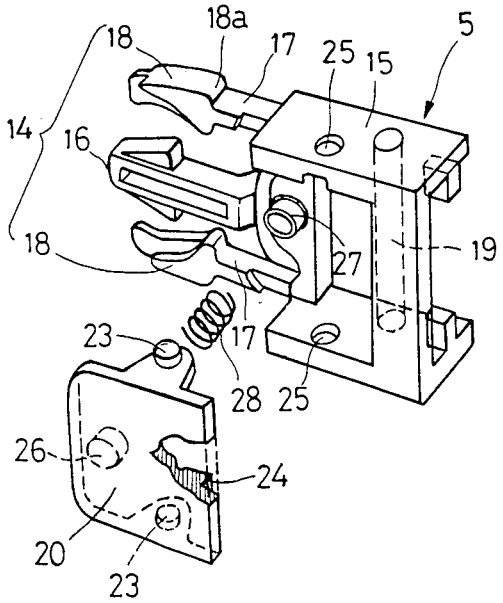

In concurrent reference with FIGS. 3, 4 and 5, each of the second coupling members 5 is made of synthetic resin and includes a plug portion 14 to be inserted into the corresponding first coupling member 4 and a retaining frame 15 for the strap 3. The plug portion 14 consists of a central guide lever 16 and a pair of elastic latch levers 17 disposed on both sides of said central guide lever 16, respectively. The pair of latch levers 17 respectively have bulges 18 adjacent the forward ends thereof so that a distance between these bulges 18 is slightly larger than the width of the first coupling member 4 at its rear end opening. Accordingly, the pair of latch levers 17 are urged inwardly against their own elasticity as the plug portion 14 is inserted into the first coupling member 4, and further insertion to the full extent causes the respective bulges 18 to protrude through the associated windows 11 under a restoring tendency of said elasticity until inner ends 18*a* of the respective bulges 18 come into engagement with respective inner ends 11*a* of said associated windows 11. From this latched condition, the bulges 18 may be forced inwardly against the elasticity of the respective latch levers 17 to disengage the respective bulges 18 from the inner ends 11*a* of the associated windows 11 and simultaneously said bulges 18 automatically slide, under the effect of said elasticity, along inner surfaces of the opposite side walls of the first coupling member 4 until the second coupling member 5 is completely withdrawn from the first coupling member 4. It will be appreciated that, upon said disengagement, the second coupling member 5 may be forcibly withdrawn from the first coupling member 4, if desired. Each of the retaining frame 15 contains a pin 19 adjacent the rear end thereof. The pin 19 is partially surrounded by said strap 3 carrying on one side thereof a group of first latch teeth 21 spaced from one another longitudinally of said strap 3 and each having a cross-section shaped in an in equilateral triangle so that said first latch teeth confront the inner surface of the outer wall of the retaining frame 15 The strap 3 is provided adjacent each end thereof on the same side as the first latch teeth 21 with a stopper 22 serving to prevent the strap 3 from slipping off from the retaining frame 15 when said stopper 22 advances into said retaining frame 15 and thereby to prevent the front of the diver's foot from slipping off from the associated fin 1 due to said strap being excessively loosened The strap 3 is further provided on both sides thereof adjacent each end with ridges 30 functioing as antiskid means for the driver's fingers when the driver handles the strap 3. The retaining frame 15 includes, in turn, a movable latching piece 20 which is provided on respective extensions of opposite side edges with shafts 23 projecting outwardly from the respective extensions, and on the inner side of said movable latching piece 20 at the rear of said shafts 23 With a latch tooth 24. Said shafts 23 are rotatably supported in respective holes 25 formed through opposite sides of the retaining frame 15. The movable latching piece 20 further includes a projection 26 formed on the inner side in front of said shafts 23 and a coil spring 28 which is held at one end around said projection 26 and at the other end around a projection 27 formed on the side of the retaining frame 15 confronting said inner side of the movable latching piece 20. Accordingly, the movable latching piece 20 is normally biased by said coil spring 28 around the shafts 23 so that the inner surface at one end of the latching piece 20 carrying the second latch tooth 24 is urged against any one of the first latch teeth 21. Thus, the second latch tooth 24 is selectively engaged with one of the first latch teeth 21 and thereby prevents the strap 3 from being forcibly displaced in the direction in which a fastening effect of said strap 3 upon the heel of the diver is loosened, i.e., in the direction as indicated by an arrow 29 in FIG. 5. On the other hand, when the strap 3 is pulled in the direction in which said strap 3 further fastens the heel of the diver i.e., in the direction opposite to that as indicated by the arrow 29, the movable latching piece 20 is urged against the action of the spring 28 around the shafts 23 so that the second latch tooth 24 correspondingly flats and slides over the first latch teeth 21, allowing the strap 3 to be displaced in said reverse direction.

In the specific embodiment shown, the strap 3 is coupled to the fin 1 by the respective buckles 6 at the opposite ends. According to the present invention, however, it is also possible that at least one end of the strap 3 is coupled by said buckle 6 to the fin 1 while the other end is unreleasably coupled to the fin 1 by suitable means and thereby the desired effect is achieved.

With the diving fin of the invention having such construction as has been described hereinabove, the first coupling member 4 is coupled to the fin 1, as previously mentioned, by pressing the first coupling member 4 towards the fin 1 with the projection 12*d* being maintained i alignment With the notch 10 so as to insert the flange 9 into the first coupling member 4 through the guide aperture 12*a*, then rotating the first coupling member 4 with respect to the fin 1 by a predetermined angle so that said projection 12*d* is angularly displaced with respect to said notch 10, and finally pulling the first coupling member 4 rearwardly with respect to the fin 1 to urge the neck portion 8 against its own elasticity through the constricted passage 12*b* into tight engagement with the interlocking aperture 12*c*.

Then, the strap 3 is held by the second coupling member 5 by placing the strap 3 adjacent the forward end thereof around the pin 19 so that the second latch tooth 24 of the movable latching piece 20 is engaged under the action of the coil spring 28 with one of the first latch teeth 21.

After such preparatory condition has been established, the diver may insert the front of the foot into the foot pocket 2 and fully insert the plug portion 14 against the elasticity of the latch levers 17 into the first coupling member 4 until the respective bulges 18 of said latch levers 17 are engaged with the associated windows 11 to couple the first coupling member 4 with the second coupling member 5. Now the strap 3 may be pulled in the direction opposite to that as indicated by the arrow 29 in FIG. 5 for adjustment of the fastening effect thereof. In this way, the fastening effect of the strap 3 can be effectively adjusted merely by pulling the strap 3 even during diving.

To take the fin 1 off, the respective bulges 18 exposed within the corresponding windows 11 are pressed with the fingers inwardly and thereby the plug portion 14 is disengaged from the first coupling member 4 or the end of the movable latching piece 20 which is remote from the second latch tooth 24 is pressed against the action of the coil spring 28 so that said second latch tooth 24 floats and then the strap 3 is pulled in the direction as indicated by said arrow 29 so as to loosen the fastening loop of the strap 3.

What is claimed is:

1. Diving fin including a heel strap coupled to opposite sides of a foot pocket wherein coupling of at least one end of said strap to at least one of said opposite sides of the foot pocket as well as adjustment of fastening effect of said strap on the diver's heel can be achieved by a buckle, said diving fin being characterized by:

said strap carrying on one side a plurality of first latch teeth arranged to be spaced from one another longitudinally of said strap;

said buckle comprising a first coupling member of sheath-like configuration and a second coupling member having a plug portion adapted to be releasably engaged into said first coupling member and a retaining frame movably supporting therearound said strap;

said retaining frame including a movable latching piece swingably supported therein by suitable support means so that said movable latching piece is normally biased by a spring and thereby the inner surface at one end is urged against any one of said first latch teeth; and said movable latching piece including a second latch tooth on said inner surface at the one end adapted to be engaged with any one of said first latch teeth in order to prevent said strap from moving in the direction in which said strap is loosened and adapted to swing off from said one of said first latch teeth around said support means against action of said spring, allowing said strap to move in said fastening direction.

2. Diving fin as recited in claim (1), wherein:

a mechanism by which said plug portion of the second coupling member is releasably engaged into said first coupling member comprising windows respectively formed through opposite sides of said first coupling member and elastic latch levers respectively disposed at opposite sides of said plug portion and provided on respective forward ends with bulges adapted to be brought into engagement with the associated windows so as to project therethrough as said plug portion is fully inserted into said first coupling member;

said engagement being released and thus said second coupling member being separated from said first coupling member by pressing said bulges inwardly against the elasticity of said latch levers.

3. Diving fin as recited in claim (1), wherein:

a mechanism by which said buckle is coupled to at least one of the opposite sides of said foot pocket comprising an interlocking projection formed integrally with said fin so as to project towards said one side of the foot pocket and said first coupling member;

said interlocking projection including a neck portion and a flange formed on the outer end of its neck portion;

said first coupling member including in its inner wall confronting said fin a guide aperture of a substantially same diameter as that of said flange and an interlocking aperture substantially corresponding in a diameter to said neck portion, said interlocking aperture communicating with said guide aperture through a constricted passage slightly narrower than said neck portion; and said first coupling member being coupled to said fin by inserting said flange into said first coupling member through said guide aperture and forcing said neck portion through said constricted passage into tight engagement with said interlocking aperture

4. Diving fin as recited in claim (1), wherein said strap is provided adjacent its end on the same side on which said first latch teeth are disposed a stopper adapted to be received in said retaining frame and thereby to prevent the strap from slipping off from said retaining frame.

5. Diving fin as recited in claim (1), wherein said first coupling member and said second coupling member are made of synthetic resin.

* * * * *